US010421292B2

(12) United States Patent
Nakanishi

(10) Patent No.: US 10,421,292 B2
(45) Date of Patent: Sep. 24, 2019

(54) CYLINDER PRINTING JIG AND PRINTER USING CYLINDER PRINTING JIG

(71) Applicant: MUTOH INDUSTRIES LTD., Tokyo (JP)

(72) Inventor: Kento Nakanishi, Nagano (JP)

(73) Assignee: MUTOH INDUSTRIES LTD., Tokyo (JP)

( * ) Notice: Subject to any disclaimer, the term of this patent is extended or adjusted under 35 U.S.C. 154(b) by 0 days.

(21) Appl. No.: 15/774,730

(22) PCT Filed: Sep. 14, 2016

(86) PCT No.: PCT/JP2016/077160

§ 371 (c)(1),
(2) Date: May 9, 2018

(87) PCT Pub. No.: WO2017/086007

PCT Pub. Date: May 26, 2017

(65) Prior Publication Data

US 2018/0304645 A1 Oct. 25, 2018

(30) Foreign Application Priority Data

Nov. 19, 2015 (JP) ..... 2015-226441

(51) Int. Cl.

| | |
|---|---|
| ***B41J 3/407*** | (2006.01) |
| ***B05C 13/02*** | (2006.01) |
| ***B41J 2/01*** | (2006.01) |

(52) U.S. Cl.

CPC ..... *B41J 3/4073* (2013.01); *B05C 13/02* (2013.01); *B41J 2/01* (2013.01); *B41J 3/407* (2013.01)

(58) Field of Classification Search

CPC .. B41J 3/407; B41J 3/4073; B41J 2/01; B05C 13/02

USPC ..... 347/16, 104

See application file for complete search history.

(56) References Cited

FOREIGN PATENT DOCUMENTS

| | | | | |
|---|---|---|---|---|
| JP | 2009056789 A | * | 3/2009 | |
| JP | 2014100880 A | * | 6/2014 | ..... B41J 3/4073 |

* cited by examiner

*Primary Examiner* — Jannelle M Lebron

(74) *Attorney, Agent, or Firm* — Wenderoth, Lind & Ponack, L.L.P.

(57) ABSTRACT

A cylinder printing jig is provided by which a table of a moving table-type printer is allowed to contact with a rotation roller to smoothly rotate a cylindrical print medium. The cylinder printing jig includes a base unit detachably fixed to a body of a moving table-type inkjet printer, a movable unit supported by the base unit, a first rotation roller rotatably connected to the movable unit, a second rotation roller rotatably connected to the movable unit at a position at which the second rotation roller does not contact the table of the printer, and an auxiliary wheel axially supported by the movable unit. The first rotation roller and the auxiliary wheel are placed on the table of the printer by the deadweight of the movable unit. The movement of the table causes the contact with the table to provide the rotation of the first rotation roller.

9 Claims, 6 Drawing Sheets

CYLINDER PRINTING JIG AND PRINTER USING CYLINDER PRINTING JIG

TECHNICAL FIELD

The present invention relates to a removable cylinder printing jig used for a moving table-type printer and a printer using the cylinder printing jig.

BACKGROUND ART

Conventionally, a printing jig has been known to perform a curved surface printing using a general printer (see Patent Publication 1). An inkjet printer including a print object retention member also has been conventionally known to perform printing on a three-dimensional object having a cylindrical part (see Patent Publication 2). A three dimensional-shaped object printing jig has been conventionally known that can perform printing on a plurality of print objects having different shapes (see Patent Publication 3).

PRIOR ART PUBLICATION

Patent Publication

Patent Publication 1: Japanese unexamined patent application publication No. 2014-205125

Patent Publication 2: Japanese unexamined patent application publication No. 2014-61510

Patent Publication 3: Japanese unexamined patent application publication No. 2012-603

SUMMARY OF THE INVENTION

Problem to be Solved by the Invention

In the case of these conventional jigs, a large-scale operation is required in which a jig exclusive for a printer apparatus is provided to exchange the table or a jig using the driving of a printer apparatus table requires an addition of an improved driving structure, thus causing a disadvantage of a difficult and cumbersome operation to attach the jig to the printer apparatus.

Furthermore, merely attaching the jig to the printer apparatus allows only the upper face of the cylinder to be printed. Thus, in order to allow the entire circumferential face of the cylinder to be printed, a disadvantage is caused where a mechanism is required to rotate the cylinder or a complicated mechanism is required to handle cylinders having various diameters for example. The jig also must be attached to the apparatus in a simple manner as much as possible in order to provide a print operation while changing the object such as a cylinder or a plate-like sheet. It is an objective of the present invention to solve the above disadvantage. According to the invention, a cylinder printing jig used for a moving table-type printer can be freely attached to or removed from a printer. Furthermore, a roller for converting the table movement to the cylinder rotation is allowed to securely have contact with a table face so that the circumferential face of the cylinder can be securely transported.

Means for Solving the Problem

In order to achieve the above objective, the present invention provides a cylinder printing jig used for a printer including a moving table, characterized in comprising: a base unit detachably fixed to a printer body; a movable unit supported by the base unit to vertically move, the movable unit being provided separately from the base unit; and a roller mechanism having a contact with the table of the printer due to the weight of the movable unit, the roller mechanism being provided in the movable unit to convert the movement of the table to the rotation of a cylindrical print medium.

The present invention is characterized in that the roller mechanism is composed of a first rotation roller rotatably connected to the movable unit, the first rotation roller having a contact with the table due to the weight of the movable unit; and a second rotation roller rotatably connected to the movable unit at a position at which the second rotation roller does not contact the table, the second rotation roller being opposed to the first rotation roller in a parallel manner and being configured to place the cylinder with the first roller or a roller interlocked with the first rotation roller.

The present invention is characterized in that the movable unit axially supports an auxiliary wheel in a rotatable manner to have a predetermined interval to the first rotation roller. When the table is positioned in a print region, the first rotation roller and the auxiliary wheel contact the table of the printer due to the weight of the movable unit. The movement of the table provides the rotation of the first rotation roller to thereby rotate a cylindrical print medium placed between the first rotation roller or the roller interlocked with the first rotation roller and the second rotation roller.

The present invention is characterized in that a mechanism to support the movable unit to vertically move is connected to the base unit and a first link unit is rotatably connected to the base unit. A free end of the first link unit is slidably connected to a guide unit extending in a direction parallel to a direction along which the table of the movable unit is moved. One side of a second link unit is rotatably connected to one side of the movable unit and the other side is rotatably connected to an intermediate section of the first link unit.

The present invention is characterized in that, the movable unit axially supports an auxiliary wheel for the print region and an auxiliary wheel for a region exterior to the print region in a rotatable manner at a position having a contact with the table when the table is moved out of the print region. The auxiliary wheel for a region exterior to the print region and the first rotation roller are used to support the movable unit on the table in a region exterior to the print region.

The present invention is characterized in providing a printer including a moving table, comprising a cylinder printing jig, the cylinder printing jig being composed of a base unit; a movable unit supported by the base unit to vertically move, the movable unit being provided separately from the base unit; and a roller mechanism having a contact with the table of the printer due to the weight of the movable unit, the roller mechanism being provided in the movable unit to convert the movement of the table to the rotation of a cylindrical print medium. The base unit of the cylinder printing jig can be detachably fixed to the body.

The present invention is characterized in that the roller mechanism of the cylinder printing jig is composed of a first rotation roller rotatably connected to the movable unit, the first rotation roller having a contact with the table due to the weight of the movable unit; and a second rotation roller rotatably connected to the movable unit at a position at which the second rotation roller does not contact the table, the second rotation roller being opposed to the first rotation roller in a parallel manner and being configured to place the cylinder with the first roller or a roller interlocked with the first rotation roller.

Effect of the Invention

According to the present invention, the jig can be attached to the printer apparatus only by partially fixing the jig to the apparatus to subsequently place the movable unit on the table. Thus, the jig can be attached and detached in a free and simple manner. A printing operation can be performed on the entire circumference of a cylinder without requiring an additional special mechanism. Furthermore, the table of the moving table-type printer always having contact with the rotation roller allows the movement of the table to be securely transmitted to the rotation roller without being slipped. Thus, the cylinder also can be rotated smoothly, thus realizing the secure transportation of the circumferential face of the cylinder.

EMBODIMENT FOR CARRYING OUT THE INVENTION

The following section will describe in detail an embodiment of the present invention with reference to the attached drawings.

Figure 2:
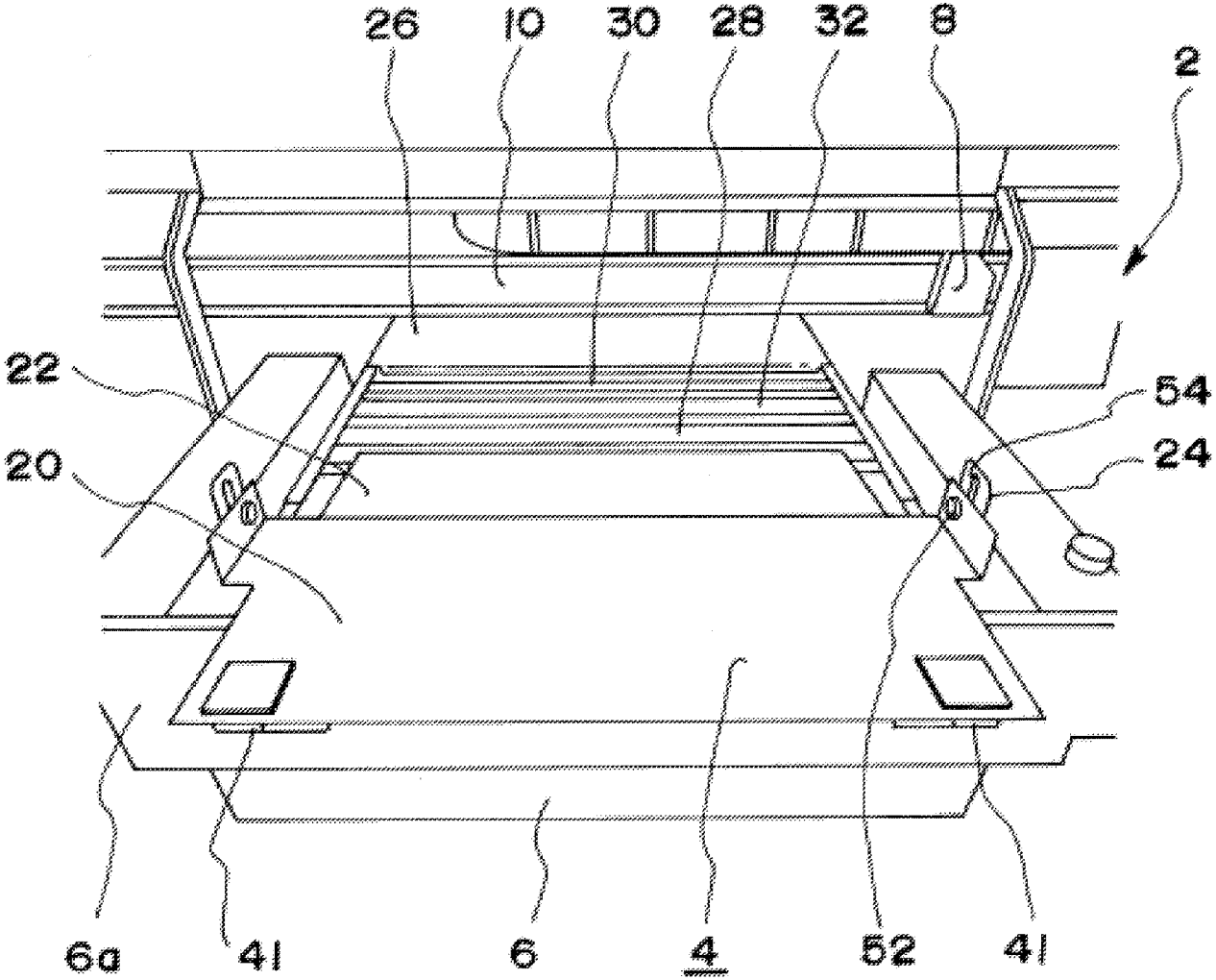
FIG. 2 illustrates the appearance showing how a jig is attached to a printer.

FIG. 2 illustrates the appearance showing how an inkjet printer 2 is attached with a cylinder printing jig 4. The printer 2 has a body 6 configured so that an inkjet print head 8 is guided by a head guide rail 10 in a main scanning direction (Y axis direction). The print head 8 is integrated with a head carriage. The head carriage is connected to the head guide rail 10 in a movable manner.

The body 6 of the printer 2 has a table 12. The table 12 (see FIG. 1) is supported by an X axis moving body 14 that can be moved in the front-and-rear direction (X axis direction) of the body 6 via an elevating mechanism 16 (see FIG. 4). The X axis moving body 14 is movably attached along an X axis guide 18 provided in the body 6 and is configured to move in the X axis direction by control by a controller. The body 6 of the printer 2 has a table elevating handle (not shown). This handle can be operated to change the height of the table 12 while the table 12 being retained to be parallel to the main scanning direction (Y axis direction) of the head 8. Thus, the distance between the print object and the inkjet head can be adjusted depending on the height of an individual object.

The printer 2 is used, when the jig 4 is detached, to perform a printing operation on a medium having a general flat face. In order to perform the printing operation on the medium, the medium is set on the table 12. Then, the controller controls the table 12 to move in the X axis direction during which the print head 8 is allowed to reciprocate along the head guide rail 10 in the Y axis direction. Ultraviolet curable ink is discharged through the print head 8 to a print execution area at the top of the medium to perform a printing operation on the print execution area of the medium. When the print execution area of the medium has a width a smaller than the width of a nozzle 8*a*, the range within which the nozzle 8*a* is used may be set to a width b corresponding to the width a of the print execution area of the medium. When a printing operation is performed on a medium having a fixed thickness, the table is lowered to adjust the distance between the print head 8 and the medium 62 to perform the printing operation. The head carriage includes an ultraviolet irradiation apparatus (not shown) to emit ultraviolet light to a to-be-printed face of the medium during the printing operation. Ink may be selected based on the print object and is not limited to ultraviolet curable ink.

Figure 3:
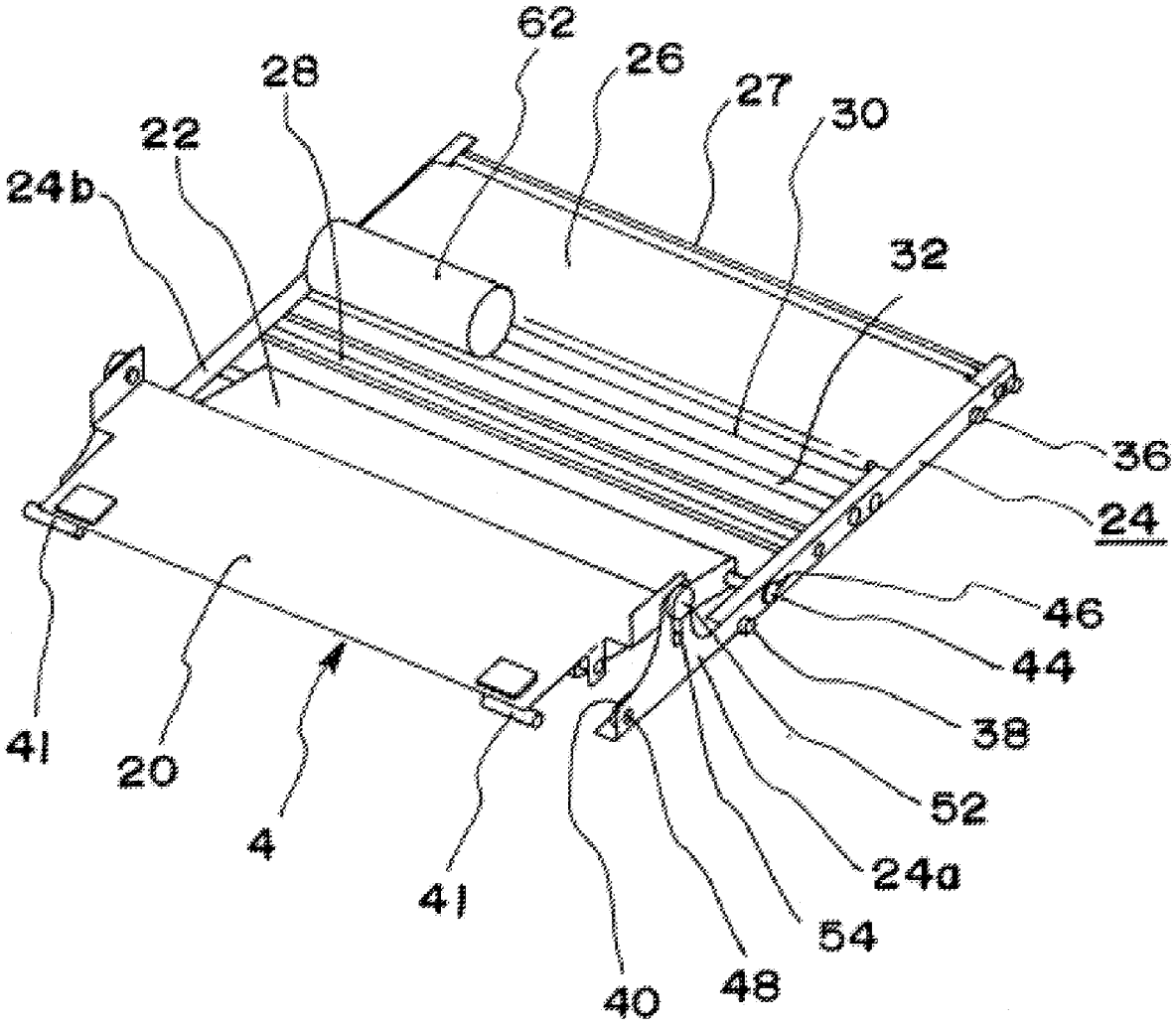
FIG. 3 illustrates the appearance showing the jig according to the present invention.

As shown in FIG. 3, the jig 4 is composed of: a base unit 20 consisting of a rectangular plate member; a first link unit 22 consisting of a rectangular plate member; a movable unit 24 consisting of a pair of mutually-parallel side frames 24*a* and 24*b*; a reinforcing unit 26 consisting of a plate member; axial reinforcing units 27 and 28; a first rotation roller 30 having a circular cross section; a second rotation roller 32 having a circular cross section; a pair of left and right auxiliary wheels 36 and 38; and a pair of second left and right link units 40. One side of the base unit 20 has a clamp mechanism 41 to detachably fix the base unit 20 to a front wall 6*a* of the body 6 of the printer 2.

Both sides of the base unit 20 have attachment pieces formed in an orthogonal direction by which both sides of one side of the first link unit 22 are rotatably supported by an axis 42. The other side of the first link unit 22 has an axis protruding in the right-and-left direction that is slidably engaged with a guide unit 46 consisting of a long hole extending in the direction along which the table 12 of the side frame 24 is moved in the front-and-read direction. The side frames 24*a* and 24*b* of the movable unit 24 that are parallel to each other have therebetween the connection of both sides of the plate-like reinforcing unit 26 and both ends of the axial reinforcing units 27 and 28.

The side frames 24*a* and 24*b* have therebetween the first rotation roller 30 and the second rotation roller 32 that are rotatably provided so as to mutually have predetermined step and interval. In this embodiment, in the direction along which the table is transported during printing, the downstream-side first rotation roller 30 is provided at the lower side and the second rotation roller 32 is provided at the upper side. This arrangement is for the purpose of preventing a cylindrical object as a print target from moving over the second rotation roller 32 during printing. Thus, the positions may be adjusted as required and the invention is not limited to this arrangement. In the-front-and-rear direction of the side frames 24*a* and 24*b*, the auxiliary wheels 36 and 38 are axially supported in a rotatable manner. The one side of the second link unit 40 is rotatably supported by an axis 48 at the front side of the side frames 24*a* and 24*b*. The other side of the second link unit 40 is rotatably supported by an axis 50 at the side of the intermediate section of the first link unit 22.

The base unit 20 has a lateral width set in accordance with the table 12. The base unit 20 has raised portions at both sides at the rear side thereof. This raised portion includes a screw hole threaded with an axis of a screw 52 that is slidably engaged with a long hole 54 formed in the side frames 24*a* and 24*b*. The long hole 54 for the elevating guide is set to extend straight relative to the face of the table 12 in the vertical direction while the side frames 24*a* and 24*b* are being placed via the roller 30, the auxiliary axis 38, or the auxiliary wheel 36 to be parallel to the table 12 by the deadweights. The long hole 54 also may be provided at the side of the base unit 20 and the screw 52 may be provided at the side of the side frame 24.

In order to adjust the height of the table 12, the axis of the screw 52 is slid to move up and down along the long hole 54 in accordance with the upward and downward movements of the table 12. When the height adjustment of the table 12 is completed, the screw 52 is tightened to fix the movable unit 24 to the base unit 20. The first rotation roller 30 is formed to have a larger diameter than that of the second rotation roller 32 and has, on the surface thereof, a friction face consisting of a rubber face in order to generate friction with the face of the table 12. The friction face is used to rotate the medium 62 by having a contact with the medium 62.

To a lower face 24*c* of the mutually-parallel side frames 24*a* and 24*b* positioned on the same plane, the rotation roller 30 and the auxiliary wheels 36 and 38 have the respective lower faces protruding in the same amount. The auxiliary wheel 36 and the rotation roller 30 of the movable unit 24 on the table 12 are caused by the deadweight of the movable unit 24 to have a contact with the table 12 and the movable unit 24 is horizontally supported on the table 12 by attaching the auxiliary wheel 36 and the rotation roller at set positions. The auxiliary wheel 38 and the rotation roller 30 of the movable unit 24 on the table 12 are configured, by the weight of the movable unit 24, to have a contact with the table 12 and the movable unit 24 is horizontally supported on the table 12 by attaching the auxiliary wheel 36 and the rotation roller 30 at set positions. The second rotation roller 32 has a lower face set to be higher than the lower face of the first rotation roller 30 and is configured not to contact the face of the table 12.

The guide unit 46 consisting of a long hole formed in the side frames 24*a* and 24*b* has the longitudinal direction set to a direction parallel to the longitudinal direction of the side frames 24*a* and 24*b* (i.e., the transportation direction of the X axis direction of the table 24). On the other hand, the long hole 54 is set in a vertical direction (i.e., a direction parallel to the elevating direction of the table 12). In order to fix the jig 4 to the body 6 of the printer 2, the handle is firstly operated to lower the table 12 of the apparatus to the print head 8 so that the jig can enter. The attachment of the jig also may be followed by the lowering of the table. However, the jig is preferably lowered at first in order to prevent the jig from being errorneously hit by the head when the head is moved to the print region. Next, the base unit 20 of the jig 4 is provided on the upper face of the body 6 of the printer 2. A locking plate 60 of the base unit 20 is provided on the back face of the front wall 6*a* of the substrate 6. A clamp axis 56 of the clamp mechanism 41 is caused to be abutted to the wall face of the body 6 in a pressurized manner by the operation of a lever 58, thereby fixing the jig 4 to the front wall 6*a* of the body 6. This fixation can be easily cancelled by operating the lever 58 to move the clamp axis 56 rearward. The clamp mechanism 41 may have an arbitrary configuration and thus the internal structure will not be described here. The jig also may be fixed to the body 6 of the apparatus by a screw for example and may be fixed by an arbitrary structure so long as the structure allows the jig to be easily attached or detached.

Figure 4A:
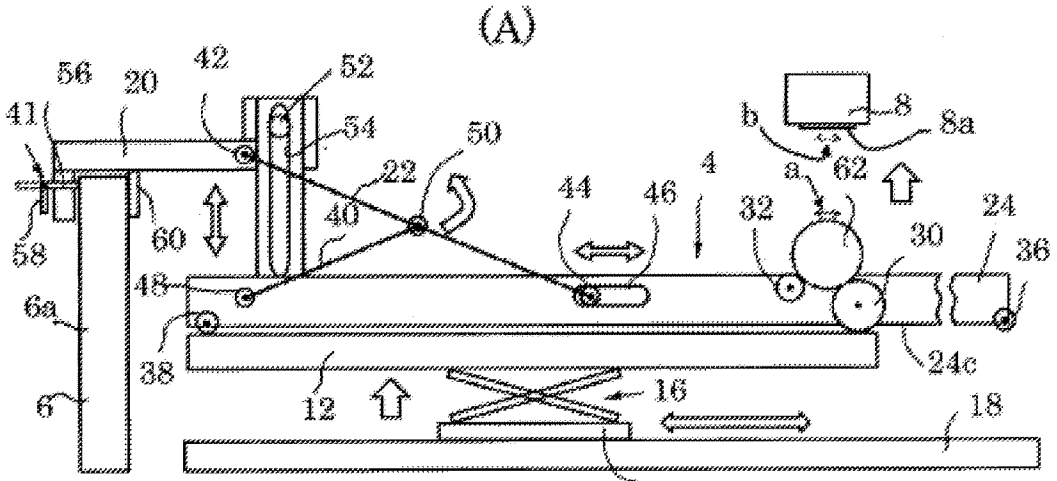
FIG. 4 illustrates the present invention.

In this embodiment, as shown in FIG. 4, the link mechanism has the distance between the axis 42 and the axis 50, the distance between the axis 48 and the axis 50, and the distance between the axis 50 and the axis 44 that are set to the same distance. The axis 48 is provided just below the axis 42.

When the base unit 20 of the jig 4 is fixed to the body 6 of the printer 2, the movable unit 24 is placed, by the deadweight, on the table 12 via the auxiliary wheel 36 and the rotation roller 30 or via the auxiliary wheel 38 and the rotation roller 30. Positions of the rollers 30 and 32 are set so that, in this status, the section between the first rotation roller 30 and the second rotation roller 32 is positioned just below the ink discharge path of the print head 8. The rollers 30 and 32 are positioned, when the print medium 62 has a cylindrical shape, within a diameter range that can be handled by the printer (a range that can be handled by the table moved in the upward or downward direction) so that the position just below the print head 8 does not change even when the medium 62 has a larger or smaller diameter. In order to place the medium 62 as a cylindrical print object on the rollers 30 and 32 to position the print height of the surface of the medium 62, the table height adjustment handle of the printer 2 is operated to move the table 12 in the upward or downward direction while observing the scale.

Figure 4B:
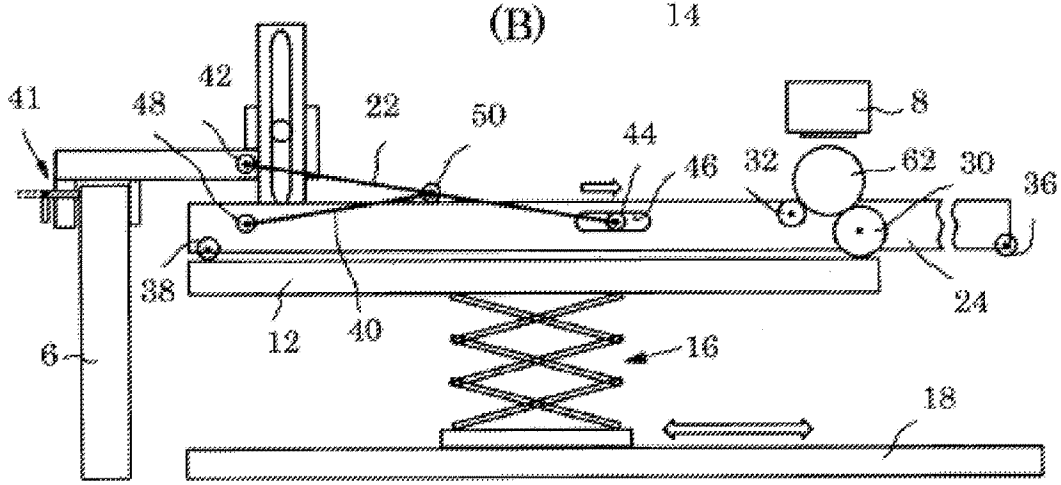
Figure 5:
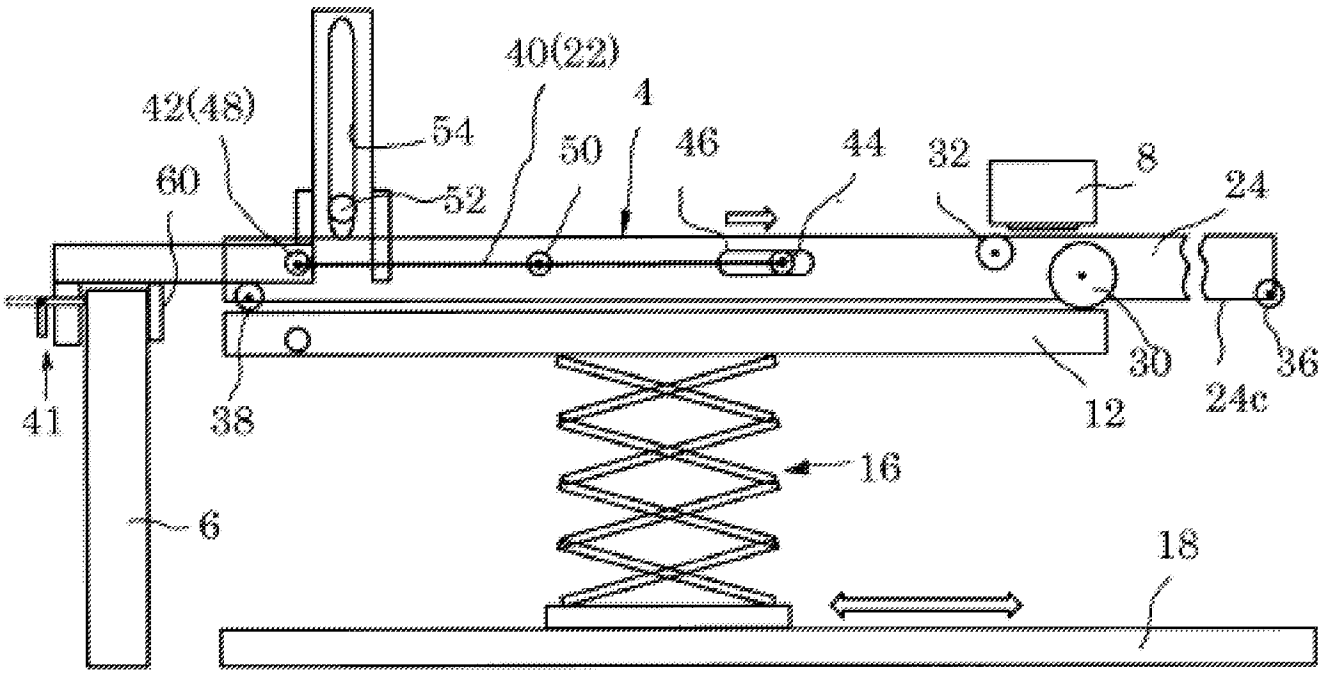
FIG. 5 illustrates the present invention.

The printer 2 may have an automatic height adjustment mechanism to detect the medium height by a sensor so that the height can be automatically adjusted. Alternatively, a member may be provided in the apparatus to limit the height of the position of the to-be-printed face (upper limit position) so that the printing face is positioned by raising the table 12 until the medium 62 is abutted to the limiting face. In this embodiment, an example is described in which the table 12 is moved in the upward or downward direction to position the to-be-printed face. However, when a structure is used in which the print head 8 is moved in the upward or downward direction, the print head 8 may be set to the surface of the medium 62. When the table 12 is raised as shown in FIG. 4(B), the connection axis 50 of the link mechanism is raised while rotating around the rotation axis 42. The axis 44 is slid along the guide unit 46 in the right direction in the drawing. When the table 12 is raised to the highest position, the connection axis 48 has the same height as that of the rotation axis 42 and the axis 44 is moved to the right side of the guide unit 46. When the table 12 is lowered from the raised position, the connection axis 50 is lowered while rotating around the rotation axis 42 and the axis 44 is slid along the guide unit 46 in the left direction in the drawing.

In accordance with the upward or downward movement of the table 24, the connection axis 48 is upwardly or downwardly moved in a straight direction and is suppressed from being moved in the right-and-left direction in FIG. 4 relative to this table 24. Thus, during the adjustment of the height of the medium 62, the position of the medium 62 is prevented from being displaced from a position just below the movement path of the print head 8 in the X axis direction (i.e., the transportation direction of the table 24).

In FIG. 4, the axis 44 can be moved along the long hole 46 in the right-and-left direction (X axis direction). Thus, the movable unit 24 can be upwardly or downwardly moved while being interlocked with the upward or downward movement of the table 12 and while being horizontal to the table 12.

Thus, when the table 12 is upwardly or downwardly moved to result in the start of the displacement of the axis 48 in the right-and-left direction in FIG. 4, the load to start the displacement of the axis 48 in the right-and-left direction acts, via the link unit 40, to push the axis 50 of the intermediate section of the link unit 22 in the upward or downward direction. If the link unit 22 can be caused by this load to push the link unit 40 in the upward or downward direction to rotate around the axis 42, this undesirably causes the axis 48 (i.e., the movable unit 24) to be displaced in the X axis direction. Thus, the link unit 22 has the axis 44 slidably engaged only in the longitudinal direction of the long hole of the guide unit 46 and thus cannot be upwardly or downwardly moved relative to the guide unit 46.

Thus, the rotation of the link unit 22 around the axis 42 is suppressed by the weight of the movable unit 24 and the guide face of the guide unit 46 formed in the movable unit 24. Thus, the axis 48 is prevented from being moved in the X axis direction in accordance with the up-and-down movement of the table. Thus, no change is caused in the position of the axis 48 on the X axis to the base unit 20, i.e., the position on the X axis of the rotation rollers 30 and 32 to the print head movement path. In this embodiment shown in FIG. 2, the plate members of the base unit 20 and the link unit 22 are sized in accordance with the lateral width of the table. However, another structure divided into the right side and the left side may be used so long as the link mechanism can act on the structure. In this case, the clamp mechanism 41 may be provided respectively and may be attached to the body 6. The link mechanism also may be provided in the vicinity of the center of the jig 4.

FIGS. 1(A), 1(B), 1(C), and 1(D) illustrate the relation between the table position and the print range.

FIG. 1(A) shows the table 12 moved to the far side of the printer 2. The table 12 is positioned to have a contact with the auxiliary wheel 36 at the rear side of the movable unit 24. In the case of a structure to move the table 12 from a further deeper position however, a tip end of the movable unit 24 at the further deeper side of the auxiliary wheel 36 may have an auxiliary wheel for the movement onto the table 12. In this structure, the table 12 can be smoothly moved without causing the axis 44 of the link mechanism to collide with the movable unit 24 even when the table 12 is at a position away from the movable unit 24.

FIG. 1(B) illustrates the position of the table 12 during printing. During printing, the first rotation roller 30 and the auxiliary wheel 36 are caused by the deadweight of the movable unit 24 to contact with the table 12. The movement of the table 12 in the X axis direction shown by the arrow in the drawing causes the first rotation roller 30 to rotate due to the contact friction with the table 12 due to the deadweight of the movable unit 24, thus causing the medium 62 to rotate to cause the second rotation roller 32 to rotate with the first rotation roller 32.

The print head 8 is reciprocated on the medium 62 while discharging ink in the Y axis direction, thereby performing the print operation on the surface of the medium 62. When the print operation of the print range at the top of the medium 62 is completed, the table 12 is moved in the forward direction to rotate the first rotation roller 30, thus allowing the next print range of the medium 62 to be transported to the top. This operation is repeated to perform the print operation on the circumferential face of the medium 62. In this embodiment, the range within which the table 12 can be moved during printing is set so that the entire circumference of the medium 62 can be printed. Thus, the transportation distance of the moving table 12 directly means the transportation distance of the circumferential face of the medium. Thus, a distance having a value equal to or larger than the circumference of the medium 62 (the maximum value loaded on the apparatus) is used as a distance from a position at which the first rotation roller 30 is used for the printing operation to the auxiliary wheel 38 at the front side. As described above, when the medium 62 in FIG. 1(A) has a diameter d and the table 12 is moved from the print start position of FIG. 1(B) to the print completion position, at least a distance of $d \times \Pi$ is required. Thus, by setting this distance to be equal to or longer than the length of the circumference corresponding to the maximum medium diameter d that can be handled by the apparatus, even when the movable unit 24 is moved onto the table 12 at three points, no influence is caused on the print operation because the print operation is completed.

Figure 1:
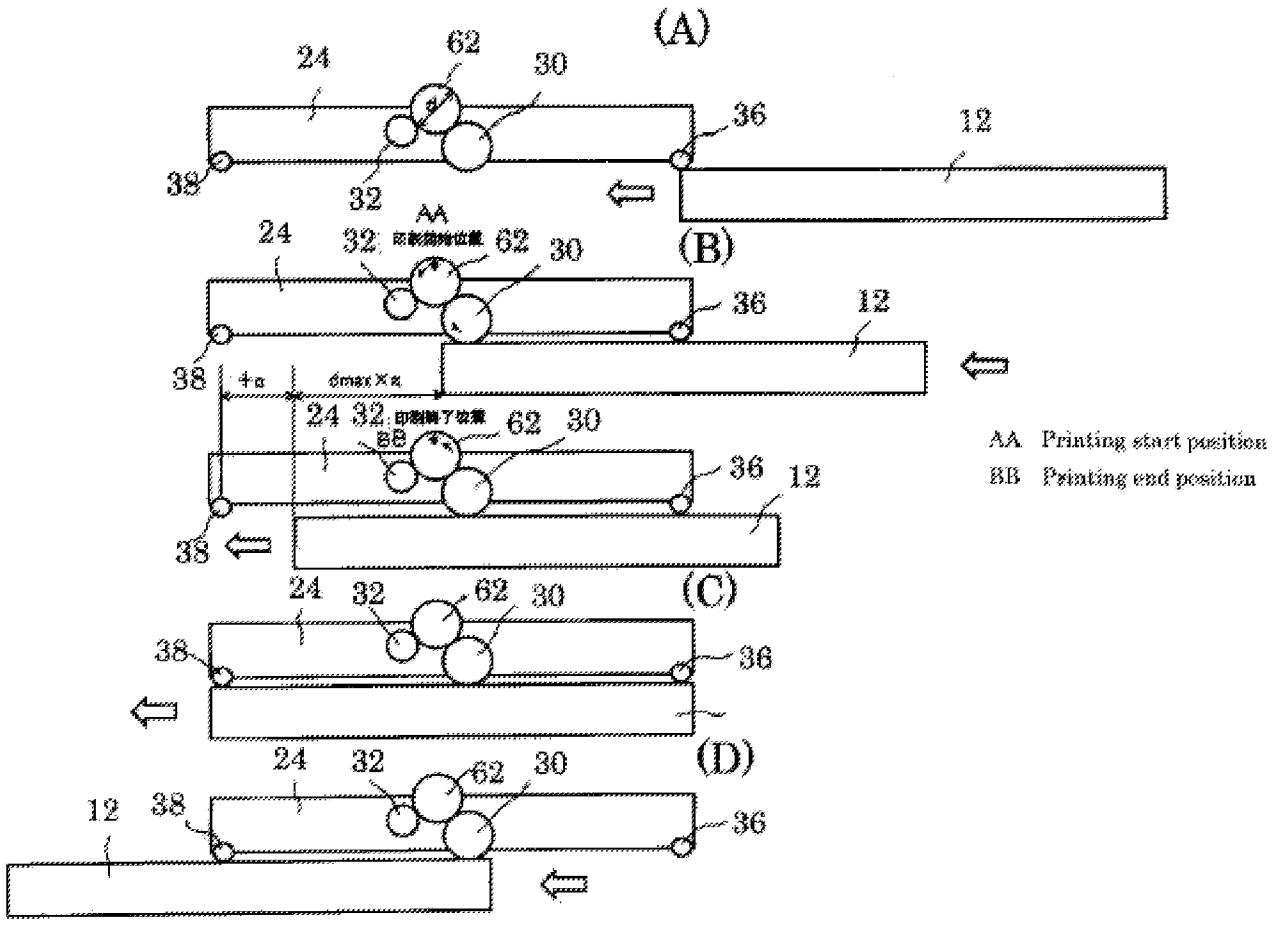
FIG. 1 illustrates the present invention.

FIG. 1(*c*) illustrates the table 12 moved in the forward direction after the completion of the print operation. The table 12 has a contact with the auxiliary wheel 38 at the front side of the movable unit 24. The movable unit 24 contacts with the table 12 at the three points of the auxiliary wheels 36 and 38 and the first rotation roller 30. In this three-point-contact status, the print operation is completed and thus no influence is caused by the three-point-contact as described above.

FIG. 1(D) illustrates the table 12 moved to a further front side after the completion of the print operation. The table 12 has a contact with two points of the auxiliary wheel 38 and the first rotation roller 30. As described above, the rotation roller 30 always contacts with the table 12 at any position at which the medium 62 must be rotated. The contact only with the rotation roller 30 also can provide rotation. Thus, such a structure may be used. However, in this embodiment, the auxiliary wheels 36 and 38 are provided at the front and rear sides in order to realize the smooth transportation of the table 12. Thus, either of the auxiliary wheel 36 or 38 and the rotation roller 32 have contact at two positions. Thus, within a range in which the table movement causes the medium 62 to rotate to perform a print operation, the rotation roller 32 is allowed to contact with the table 12 without being raised so that the medium 62 can be transported securely. The three-point contact structure also can prevent the rotation roller 32 from being raised. However, even when the intermediate rotation roller 32 is slightly raised, no influence is caused because the print operation is completed at the time of the raise.

In FIGS. 1(A) to 1(D), the table 12 is transported for a long distance. However, this structure subjects the medium 62 to the print operation after the medium 62 has a contact with the rotation roller 30. Thus, the table 12 may be transported only for a distance from the print start position to the print completion position as shown in FIG. 1(B). Thus, when the print operation is desired to be performed in an efficient manner, the table 12 may be controlled to move only within the required transportation distance.

In this embodiment, the apparatus has been described that performs the print operation by the movement of the head in the Y axis direction. However, when a line-type inkjet head is used, the print operation may be performed, without moving the head in the Y axis direction, only by moving the table to continuously rotate the medium 62. Thus, various structures may be selected within the scope not deviating from the concept of the present invention.

Figure 6:
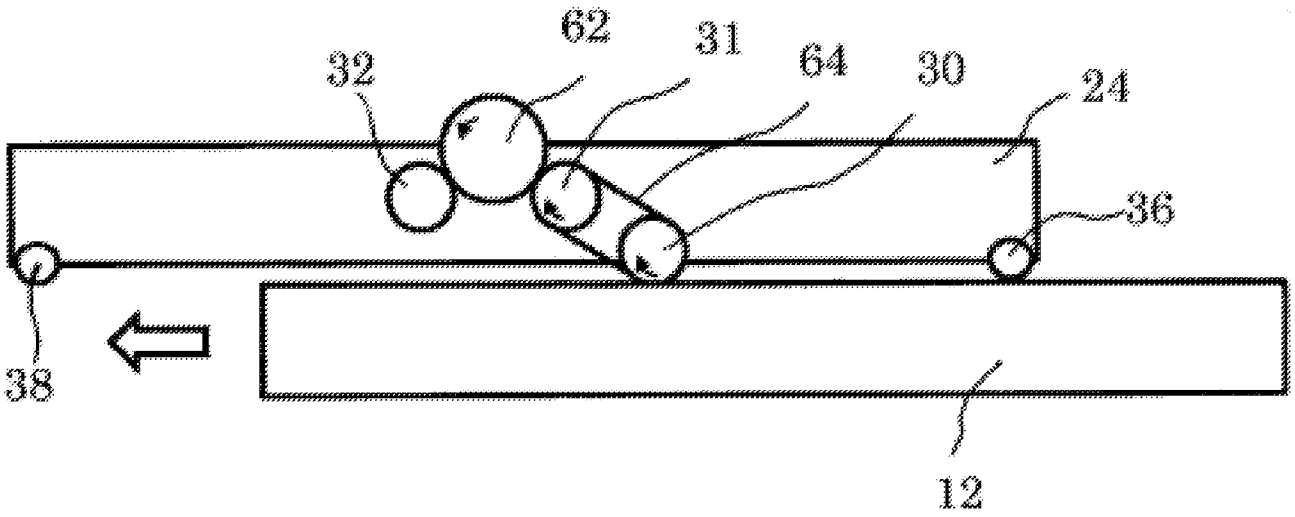
FIG. 6 illustrates another embodiment of the present invention.

The roller mechanism that is provided in the movable unit 24 to have a contact with the table 12 due to the weight of the movable unit 24 to convert the movement of the table 12 to the rotation of the cylindrical print medium 62 is not limited to the one shown in the above embodiment having one pair of the first rotation roller 30 and the second rotation roller 32. Another configuration as shown in FIG. 6 may be used in which the movable unit 24 has a roller 31 provided in a rotatable manner in addition to the first roller 30. The roller 31 is connected to the first rotation roller 30 via a power transmission means such as an endless belt 64 or a gear so that the roller 31 can be rotated together with the first rotation roller 30. The interlocked rotation roller 31 and the second rotation roller 32 may support the cylindrical print medium 62. Thus, various configurations can be used.

When a structure is used to provide the contact by using a connection mechanism, the table transportation distance can be different from the rotation distance of the medium 62 by changing a gear ratio for example. Thus, the medium can be rotated with a large or small distance. When the print operation may be performed within the print range of the inkjet head for example, a mechanism to rotate the print head 8 by 90 degrees also can be provided to directly use the print width of the print head 8 or the direction along which the table movement is transmitted is converted by 90 degrees by a gear for example to rotate the roller supporting the medium around the X axis. Thus, an appropriate structure may be selected within the scope not deviating from the scope of the present invention.

DESCRIPTION OF THE REFERENCE NUMERALS

2 Inkjet printer
4 Cylinder printing jig
6 Body
8 Print head
8*a* Nozzle
10 Head guide rail
12 Table
14 X axis moving body
16 Elevating mechanism
18 X axis guide
20 Base unit
22 First link unit
24 Movable unit
26 Reinforcing unit
27 Reinforcing unit
28 Reinforcing unit
30 First rotation roller
31 Interlock rotation roller
32 Second rotation roller
36 Auxiliary wheel
38 Auxiliary wheel
40 Second link unit
41 Clamp mechanism
42 Axis
44 Axis
46 Guide unit
48 Axis
50 Axis
52 Screw
54 Long hole
56 Clamp mechanism
58 Lever
60 Locking plate
62 Medium
64 Endless belt

What is claimed is:

1. A cylinder printing jig used for a printer including a moving table, comprising:

a base unit detachably fixed to a printer body;

a movable unit supported by the base unit to vertically move, the movable unit being provided separately from the base unit; and a roller mechanism having contact with the table of the printer due to the weight of the movable unit, the roller mechanism being provided in the movable unit to convert the movement of the table to the rotation of a cylindrical print medium, wherein the roller mechanism is composed of:

a first rotation roller rotatably connected to the movable unit, the first rotation roller having contact with the table due to the weight of the movable unit; and a second rotation roller rotatably connected to the movable unit at a position at which the second rotation roller does not contact the table, the second rotation roller being opposed to the first rotation roller in a parallel manner, and the first rotation roller and the second rotation roller are used to place the cylindrical print medium.

2. The cylinder printing jig according to claim 1, wherein a mechanism to support the movable unit to vertically move is connected to the base unit and a first link unit is rotatably connected to the base unit, a free end of the first link unit is slidably connected to a guide unit extending in a direction parallel to a direction along which the table of the movable unit is moved and, one side of the second link unit is rotatably connected to one side of the movable unit and the other side is rotatably connected to an intermediate section of the first link unit.

3. The cylinder printing jig according to claim 1, wherein the movable unit axially supports an auxiliary wheel in a rotatable manner to have a predetermined interval to the first rotation roller and, when the table is positioned in a print region, the first rotation roller and the auxiliary wheel contact the table of the printer due to the weight of the movable unit, and the movement of the table provides the rotation of the first rotation roller to thereby rotate a cylindrical print medium placed between the first rotation roller and the second rotation roller.

4. The cylinder printing jig according to claim 3, wherein the movable unit axially supports an auxiliary wheel for the print region and an auxiliary wheel for a region exterior to the print region in a rotatable manner at a position having a contact with the table when the table is moved out of the print region and, the auxiliary wheel for a region exterior to the print region and the first rotation roller are used to support the movable unit on the table in a region exterior to the print region.

5. A cylinder printing jig used for a printer including a moving table, comprising:

a base unit detachably fixed to a printer body;

a movable unit supported by the base unit to vertically move, the movable unit being provided separately from the base unit; and a roller mechanism having contact with the table of the printer due to the weight of the movable unit, the roller mechanism being provided in the movable unit to convert the movement of the table to the rotation of a cylindrical print medium, wherein the roller mechanism is composed of:

a first rotation roller rotatably connected to the movable unit, the first rotation roller having contact with the table due to the weight of the movable unit;

a rotation roller rotatably connected to the movable unit and being interlocked with the first rotation roller; and a second rotation roller rotatably connected to the movable unit at a position at which the second rotation roller does not contact the table, the second rotation roller being opposed to the rotation roller in a parallel manner, and the interlocked rotation roller and the second rotation roller are used to place the cylindrical print medium.

6. The cylinder printing jig according to claim 5, wherein the movable unit axially supports an auxiliary wheel in a rotatable manner to have a predetermined interval to the first rotation roller and, when the table is positioned in a print region, the first rotation roller and the auxiliary wheel contact the table of the printer due to the weight of the movable unit, and the movement of the table provides the rotation of the first rotation roller to thereby rotate a cylindrical print medium placed between a roller interlocked with the first rotation roller and the second rotation roller.

7. The cylinder printing jig according to claim 6, wherein the movable unit axially supports an auxiliary wheel for the print region and an auxiliary wheel for a region exterior to the print region in a rotatable manner at a position having a contact with the table when the table is moved out of the print region and, the auxiliary wheel for a region exterior to the print region and the first rotation roller are used to support the movable unit on the table in a region exterior to the print region.

8. A printer including a moving table comprising a cylinder printing jig, the cylinder printing jig being composed of:

a base unit;

a movable unit supported by the base unit to vertically move, the movable unit being provided separately from the base unit; and a roller mechanism having contact with the table of the printer due to the weight of the movable unit, the roller mechanism being provided in the movable unit to convert the movement of the table to rotation of a cylindrical print medium, and the base unit of the cylinder printing jig can be detachably fixed to the body, wherein the roller mechanism of the cylinder printing jig includes:

a first rotation roller rotatably connected to the movable unit, the first rotation roller having contact with the table due to the weight of the movable unit; and a second rotation roller rotatably connected to the movable unit at a position at which the second rotation roller does not contact the table, the second rotation roller being opposed to the first rotation roller in a parallel manner and being configured to place the cylindrical print medium with the first rotation roller and the second rotation roller.

9. A printer including a moving table comprising a cylinder printing jig, the cylinder printing jig being composed of:

a base unit;

a movable unit supported by the base unit to vertically move, the movable unit being provided separately from the base unit; and a roller mechanism having contact with the table of the printer due to the weight of the movable unit, the roller mechanism being provided in the movable unit to convert movement of the table to rotation of a cylindrical print medium, and the base unit of the cylinder printing jig can be detachably fixed to the body, wherein the roller mechanism of the cylinder printing jig includes:

a first rotation roller rotatably connected to the movable unit, the first rotation roller having contact with the table due to the weight of the movable unit;

a second rotation roller rotatably connected to the movable unit at a position at which the second rotation roller does not contact the table, the second rotation roller being opposed to the first rotation roller in a parallel manner; and a rotation roller rotatably connected to the movable unit and being interlocked with the first rotation roller, the interlocked rotation roller and the second rotation roller being arranged to place the cylindrical print medium.

* * * * *